US011331559B2

(12) United States Patent
Zagury

(10) Patent No.: US 11,331,559 B2
(45) Date of Patent: May 17, 2022

(54) COUPLING DEVICE AND SYSTEM FOR AIDING LEARNING OF A SLIDING SPORT ON TWO SKATES

(71) Applicant: Alain Zagury, Soral (CH)

(72) Inventor: Alain Zagury, Soral (CH)

( * ) Notice: Subject to any disclaimer, the term of this patent is extended or adjusted under 35 U.S.C. 154(b) by 0 days.

(21) Appl. No.: 17/291,920

(22) PCT Filed: Nov. 13, 2019

(86) PCT No.: PCT/EP2019/081121
§ 371 (c)(1),
(2) Date: May 6, 2021

(87) PCT Pub. No.: WO2020/099458
PCT Pub. Date: May 22, 2020

(65) Prior Publication Data

US 2022/0008807 A1 Jan. 13, 2022

(30) Foreign Application Priority Data

Nov. 13, 2018 (FR) ..... 1871505

(51) Int. Cl.
*A63C 5/16* (2006.01)

(52) U.S. Cl.
CPC ..... *A63C 5/16* (2013.01)

(58) Field of Classification Search
CPC ..... A63C 5/16
USPC ..... 280/818
See application file for complete search history.

(56) References Cited

U.S. PATENT DOCUMENTS 3,171,667 A * 3/1965 Wightman ..... A63C 5/16 280/818
3,357,714 A * 12/1967 Kuehn ..... A63C 5/16 280/818
3,703,299 A * 11/1972 Kutchma ..... A63C 5/16 280/818
3,751,056 A * 8/1973 Wightman ..... F16B 9/07 280/818
3,862,764 A * 1/1975 Hartz ..... A63C 5/16 280/818
3,907,320 A * 9/1975 Charneck ..... A63C 5/16 280/818
3,992,022 A * 11/1976 Albers ..... A63B 69/18 280/818
4,460,344 A * 7/1984 Notermann ..... A63C 5/16 441/73
4,817,988 A * 4/1989 Chauvet ..... A63C 5/16 280/817

(Continued)

FOREIGN PATENT DOCUMENTS

DE 2406754 A1 8/1975
WO 2010080876 A2 7/2010

*Primary Examiner* — Jeffrey J Restifo
(74) *Attorney, Agent, or Firm* — David Guerra

(57) ABSTRACT

The invention relates to a mating device (2) for mating two skates, characterized in that it comprises a first fastening module (6) and a second fastening module (6'), each designed to be fastened to a skate and comprising a body (7) between the two fastening modules (6, 6'), the said body (7) allowing at least a translational freedom between the two fastening elements (6, 6'), the distance between the two fastening modules (6, 6') being free between a predetermined minimum distance and a predetermined maximum distance.

16 Claims, 4 Drawing Sheets

(56) References Cited

U.S. PATENT DOCUMENTS

| | | | | | |
|---|---|---|---|---|---|
| 4,828,288 | A * | 5/1989 | Humbert | A63C 5/16 | 280/818 |
| 4,936,603 | A * | 6/1990 | Reynaud | A63C 5/16 | 280/818 |
| D366,083 | S * | 1/1996 | Zemke | D21/774 | |
| 5,531,480 | A * | 7/1996 | Foertsch | A63C 5/16 | 280/817 |
| 8,038,171 | B2 * | 10/2011 | Bailey | A63C 5/16 | 280/818 |
| 8,342,575 | B2 * | 1/2013 | Coleman | F16B 2/185 | 280/818 |
| 8,602,455 | B2 * | 12/2013 | Ligouri | A63C 5/16 | 280/818 |
| 9,192,846 | B2 * | 11/2015 | Ruiz | A63C 5/16 | |
| 9,468,308 | B2 * | 10/2016 | Funger | A47C 31/11 | |
| 9,950,233 | B2 * | 4/2018 | Bilbao | A63B 21/4015 | |
| 2009/0039635 | A1 * | 2/2009 | Bailey | A63C 5/16 | 280/818 |
| 2010/0173273 | A1 * | 7/2010 | Bilbao | A63B 69/18 | 434/253 |
| 2011/0109072 | A1 * | 5/2011 | Ligouri | A63C 5/16 | 280/818 |
| 2012/0242071 | A1 * | 9/2012 | Coleman | A63C 5/16 | 280/818 |
| 2013/0277956 | A1 * | 10/2013 | Walburn | A63C 5/16 | 280/818 |
| 2015/0028577 | A1 * | 1/2015 | Ruiz | A63C 5/16 | 280/818 |

* cited by examiner

COUPLING DEVICE AND SYSTEM FOR AIDING LEARNING OF A SLIDING SPORT ON TWO SKATES

CROSS-REFERENCE TO RELATED APPLICATIONS

This application is an U.S. national phase application under 35 U.S.C. § 371 based upon co-pending International Application No. PCT/EP2019/081121 filed on Nov. 13, 2019. Additionally, this U.S. national phase application claims the benefit of priority of co-pending International Application No. PCT/EP2019/081121 filed on Nov. 13, 2019 and France Application No. 1871505 filed on Nov. 13, 2018. The entire disclosures of the prior applications are incorporated herein by reference. The international application was published on May 22, 2020 under Publication No. WO 2020/099458 A1.

BACKGROUND

Technical Field

The invention concerns a coupling device between two skates. The invention also relates to a system for assisting the learning of a sliding sport on two skates, especially skis.

Background Description

Similar devices are known from the prior art.

Application EP0561125, for example, describes a device for securing and directing a learner while skiing. This device consists primarily of a harness that is worn by the learner and an endless leash connected to said harness. This leash allows another person, such as a ski instructor, to hold the learner on the slope and direct him/her.

However, this approach has the disadvantage of having an unfavorable influence on the learner's balance, particularly by modifying the position of the pelvis.

Other known devices, composed of at least one strand fixed on at least one skate, allow to regulate the learner's speed, but they do not allow to limit the convergence and/or the divergence of the skates, sources of imbalance and loss of control, nor to favor a forward position of the pelvis to allow the learner to be better positioned on his/her skis.

The purpose of the invention is to improve the known systems for assisting the learning of a sliding sport on skates, especially skis.

SUMMARY

The present invention is more particularly to realize a system allowing a beginner to experience his/her first gliding sensations in the most realistic way possible and in complete safety.

This invention relates to a coupling device for coupling two skates. The device includes a first fastening module and a second fastening module, each designed to be attached to a skate. The device further comprises a body between the two fastening modules, said body allowing at least a translational freedom between the two fastening elements. The distance between the two fastening modules is free between a predetermined minimum distance and a predetermined maximum distance.

In one embodiment, the body comprises at least one sliding connection. The sliding connection comprises at least a first stop and at least a second stop to keep the distance between the two fastening modules respectively between the predetermined minimum distance and the predetermined maximum distance.

In one embodiment, the device comprises damping means for progressive locking against the first stop and/or against the second stop.

In one embodiment, each fastener module is mechanically connected to the body by a ball and socket joint.

The invention also relates to a system for assisting the learning of a sliding sport on two skates, in particular two skis, comprising a coupling device according to the invention.

In one embodiment, the system comprises at least one strand, a first end of which is attached to the fastening module and the second end of which is intended to be attached to the user, in particular for holding the user's pelvis forward.

In one embodiment, the system includes an automatic winder to keep the strand under tension and to lock the strand when said strand reaches a predefined maximum length.

In one embodiment, the system comprises at least one leash with two guide strands, each guide strand designed to be attached to a skate or fastening module so that the skates can be slowed or guided by said guide strands.

In one embodiment, each guide strand includes an automatic winder for controlling the length of each guide strand, the automatic winder including a trigger for causing the guide strand to wind or unwind.

In one embodiment, each guide strand comprises.

at least one elastic portion, and at least one breakable or detachable portion designed to separate the guide strand into two parts upon mechanical stress in excess of a predetermined stress.

In one embodiment, the system further comprises a GPS chip connected to an electronic device by an information transmission means.

In one embodiment, the invention relates to a learner position-keeping device comprising a fastening module for attachment to a skate, the device comprising at least one strand, a first end of which is connected to the fastening module and the second end of which is adapted to be attached to the learner, preferably to assist in maintaining a forward position.

Said strand may include an automatic retractor and/or means for adjusting the length of the strand, preferably attached to the fastening module.

BRIEF DESCRIPTION OF THE DRAWINGS

The attached drawings represent, by way of example, embodiments of a mating device and a support system to learn a sliding sport on skates according to the invention.

DETAILED DESCRIPTION OF THE EMBODIMENTS

An example of a support system 1 and a mating device according to embodiments of the invention are described below with reference to FIGS. 1 to 10. To ease reading, the same references will be used in the various embodiments to designate the same or equivalent components.

Figure 1:
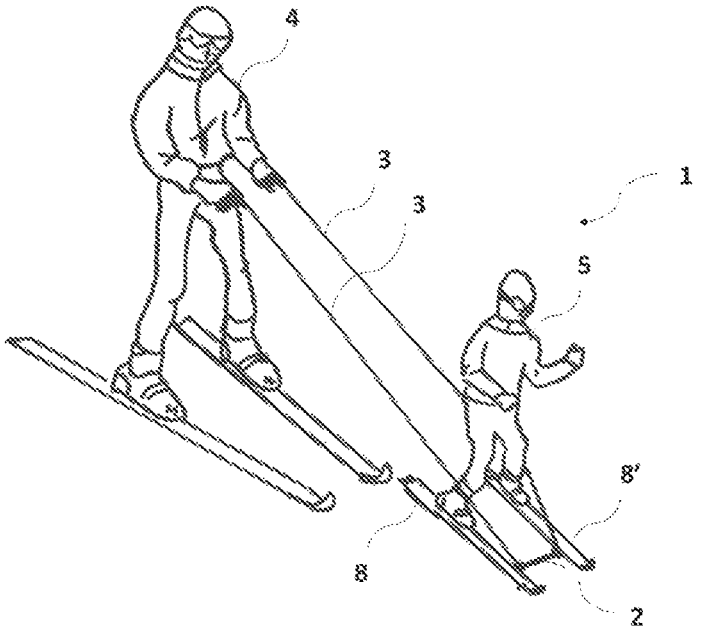
FIG. 1 depicts a learner and an instructor using the system according to one embodiment of the present invention.

The system shown in FIG. 1 has a leash comprising at least two strands 3. Each strand 3 is designed to be attached to a skate 8 of the learner 5 and held by another person 4, who will be referred to as an "instructor" in this description.

Instructor 4 can thus control the speed of learner 5 and help him to change direction by moving inside the turn and/or by pulling on the strands 3.

System 1 also includes a mating device 2.

The mating device 2 comprises at feast two fastening modules 8, 6'. Each fastening module 6, 6' is designed to be attached to a skate 8, 8'. The two fastening modules 6, 6' are connected to each other by a body 7. The body 7 is thus connected to the two fastening modules 6, 6'. Advantageously, each end of the body 7 is connected to a fastening module. Furthermore, the body 7 extends between the two fastening modules 6, 6'.

Figure 2:
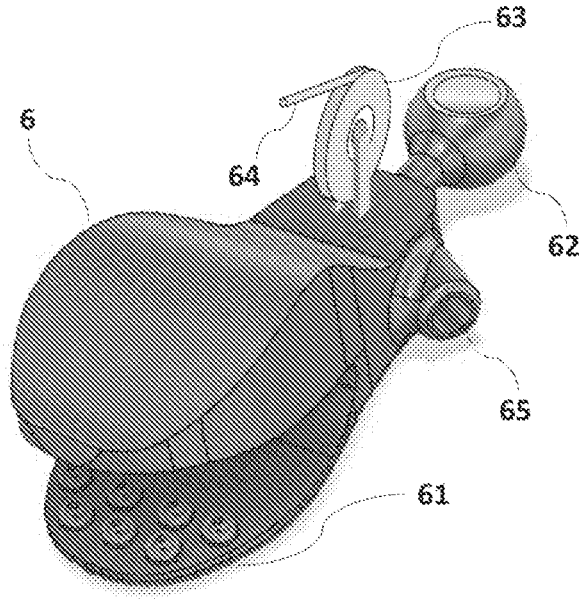
FIG. 2 is a perspective view of a fastening module according to one embodiment of the invention. The fastening module is used to attach the body of the mating device to each skate.

A fastening module 6 according to a preferred embodiment of the invention is illustrated in FIG. 2. The fastening module 6 comprises at least one fastening element 61 to fix to the shoe 8, 8' and at least one connecting means 62 for connecting to the body 7 of the mating device 2.

The fastener 61 may include a shoe to be reversibly attached to a skate. For example, the fastener 61 may include a suction cup and/or clamp system. In an embodiment illustrated in FIG. 7, the fastener comprises a shoe.

Figure 8:
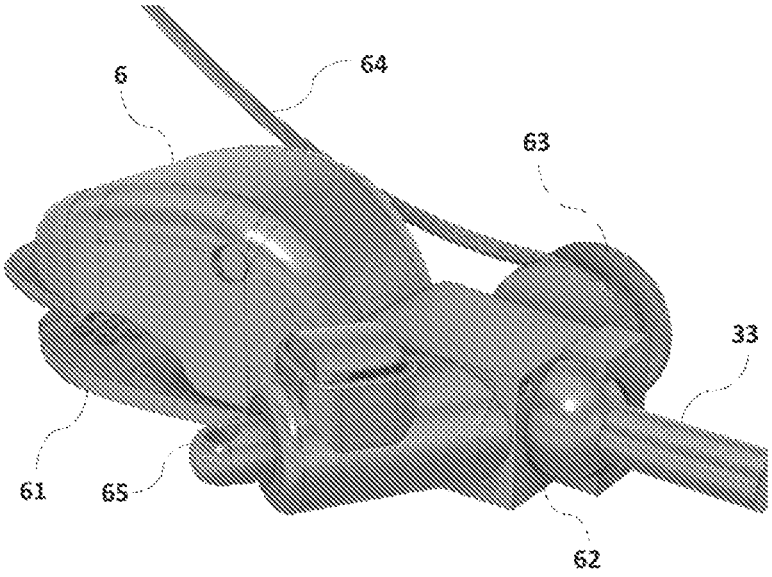
FIG. 8 is a perspective view of a fastening module according to one embodiment of the invention forming a connection with the carriage of the mating device body.

The connecting means 62 is intended to cooperate with a connecting means of the body 7. The connecting means 62 is preferably designed to form a ball-and-socket connection with the body 7. The connecting means 62 of the fastening module 6 illustrated in FIG. 2 comprises a female ball joint but could compose a male ball joint. As illustrated in FIG. 8, the connecting means allows for the reception of a complementary connecting means of a carriage 33.

The fastening module 6 further comprises a female connector 65 for connecting a guide strand 3.

The mating device 2 may further include at least one strand 64, a first end of which is connected to the fastening module 6 and the second end of which is designed to be attached to learner 5 to assist in maintaining a forward position. This strand 64 is used to assist learners, particularly young children, in maintaining their pelvis toward the front of the skates. The strand 64 is used to connect the fastening module 6 to the body of learner 5.

Said strand 64 may include an automatic winder 63 and/or means for adjusting the length of the strand. The automatic winder 63 is used to keep strand 64 under tension. The automatic winder 63 also allows strand 64 to be locked from unwinding when strand 64 reaches a predefined maximum length. In one embodiment, the automatic winder includes a means for adjusting said predefined length, for example, a push button (not shown). The push button allows, for example, the winder to be released from a return spring and the predefined length of strand 6A to be changed.

On the other hand, the at least one strand 64 can be used as a visual guide to practice edge grips by highlighting pelvic movements.

The second end preferably includes reversible VELCRO® type fasteners or a carabiner for attachment to the learners body. Preferably, strand 64 is designed to be attached to the learner's clothing, for example at the waist level, so as to prevent the learner from tilting his/her pelvis backwards. These fasteners are designed to release in the event of severe tension on the strand.

In one embodiment, the invention relates to a learner position-keeping device comprising a fastening module 6 for attachment to a skate, the device comprising at least one strand 64, a first end of which is connected to the fastening module 6 and the second end of which is designed to be attached to learner 5, preferably to assist in maintaining a forward position. Said strand 64 may include an automatic retractor 63 and/or a strand length adjustment means, preferably attached to fastening module 6.

The fastening module 6 can then be designed to fit on a ski or snowboard.

Mating device 2 as a whole is described below with reference to FIGS. 3, 4, 5, 9 and 10.

Said mating device 2 advantageously allows, on the one hand, to force learner 5 to keep his/her two skates 8 within a predetermined distance range, and on the other hand, to limit the divergence and convergence of skates.

Mating device 2 is designed to allow at least one translation of the first fastening module 6 relative to the second fastening module 6' so that the distance between the two fastening modules can be free between a first predetermined minimum distance and a second predetermined maximum distance. By a free distance, it is meant here that the learner can move his/her skates and thus the two fastening modules towards and away from each other between a maximum distance and a minimum distance.

This controlled freedom makes it possible to force learner 5 to maintain his/her skates 8, 8' within a predetermined and adjustable range of distance from each other. Alternatively, in all embodiments, the movement towards and/or away from each other between the two skates 8, and thus between the two fastening modules 6, 6' could be done by any other movement than a translation, but preferably by a translation.

Mating device 2 further comprises body 7 between the two fastening elements 6, 6'. Preferably, body 7 allows at least one translation between the connecting means 62, 62' of the fastening modules 6, 6'.

Mating device 2 includes body 7 composing a first portion 11 and a second portion 12. Body 7 links connecting means 62 of the first fastening module 6 to the connecting means 62' of the second fastening module 6'.

At least one, preferably both portions 11, 12, includes a slide 32, 32' designed to receive a carriage 33, 33'. The carriage 33, 33' is thus connected to one of the portions 11, 12 with one degree of translational freedom. Alternatively, another movement can be envisaged, particularly a translation.

The carriage 33, 33' is linked to a connecting means 62, 62' of a fastening module 6, 6'. The mechanical link between the carriage 33, 33' and the connecting means 62, 62' may comprise a mechanical link allowing at least one rotational degree of freedom. Preferably, the mechanical link between the carriage 33, 33' and the fastening module 6, 6' is a ball-and-socket connection, allowing three degrees of freedom in rotation. This ball-and-socket joint allows, when the skates 8, 8' are skis, not to prevent the skier from taking an edge.

Preferably, the carriage 33, 33' comprises a portion adapted to cooperate with the connecting means 62 so as to form a ball-and-socket joint.

The slide 32, 32' may include at least a first stop 13, 13' for blocking translation of the carriage 33, 33' in a first direction. The slide may further include at least a second stop 14, 14' to block translation of the carriage 33, 33' in a second direction opposite the first direction.

As one skate moves relative to the other, the carriage 33, 33' follows the slide between the first stop 13, 13' and the second stop 14, 14'.

During the movement of one skate relative to the other, the carriage 33, 33' can thus move along the slide 32, 32' between the first stop 13, 13' and the second stop 14, 14'.

As the skates move away, the at least one carriage 33, 33' slides along the track 32, 32' to the at least one first stop 13, 13', defining a maximum distance between the connecting means 62, 62' of each fastening module 6, 6'.

On the opposite, when the skates are brought together, the at least one carriage 33, 33' slides along the slideway 32, 32' until it reaches the at least one second stop 14, 14', defining a minimum distance between the fastening elements 6, 6'.

In one embodiment, the position along the slide of at least one stop 13, 13', 14, 14' is adjustable.

The at least one first stop 13, 13' and/or the at least one second stop 14, 14' can be moved along the slide 32, 32'. This improvement advantageously allows the maximum and minimum distances to be modified according to the learner's progress and/or according to the learner.

The at least one second stop can even be removed to set the minimum distance to about 0 cm. The first minimum distance and/or the second maximum distance are variable depending on the position of the stops.

In one embodiment, the first predetermined minimum distance between the two connecting means 62, 62' is between 0 cm and 35 cm.

In one embodiment, the second predetermined maximum distance between the two connecting means 62, 62' is between 2 cm and 40 cm.

In one embodiment, the distance between the first minimum distance and the second maximum distance is between 2 cm and 40 cm.

The first minimum distance and the second minimum distance can be adjusted by moving one or more stops 13, 13', 14, 14' along the slide 32, 32'. In one embodiment, the first stops are removable from the slide so as to predetermine the first minimum distance to 0 cm.

Preferably, body 7 may comprise at least one re-centering and/or damping means for progressively locking the carriage 33, 33' against the first stop 13, 13' or against the second stop 14, 14'.

The first stop 13, 13' and/or the second stop 14, 14' may comprise the at least one re-centering and damping means 15. The one or more re-centering and damping means 15 may comprise a compressible material such as a foam or elastomer. The one or more re-centering and damping means 15 may compose a spring.

These re-centering and damping means 15 allow learner 5 to promote the repositioning of the skates in the center of the predefined spacing between the stops 13, 13' and the stops 14, 14'.

The fastening between the first portion 11 and the second portion 12 may compose a breakable or detachable fastening. This fastening of the first portion 11 and the second portion 12 to each other is advantageously a reversible detachable connection. In particular, this fastening can be automatically detachable in the event of excessive stress. This fastening advantageously allows the automatic or semi-automatic fastening, for example assisted, of the two portions 11, 12. For this mutual fastening, each portion 11, 12 comprises corresponding connection elements.

Said breakable or detachable fastener according to the embodiment is, for example, designed to separate the first portion 11 from the second portion 12 in the event of a mechanical shock greater than a predetermined stress. This disjunction of the body 7 makes it possible to limit certain risks of injury, for example in the case where the learner removes only one foot while the two skates remain connected by the device.

Said releasable fastener may comprise a removable or reversible connection. For example, the releasable fastener may comprise a VELCRO® type fastener or a flexible hook and/or loop closure.

Figure 3:
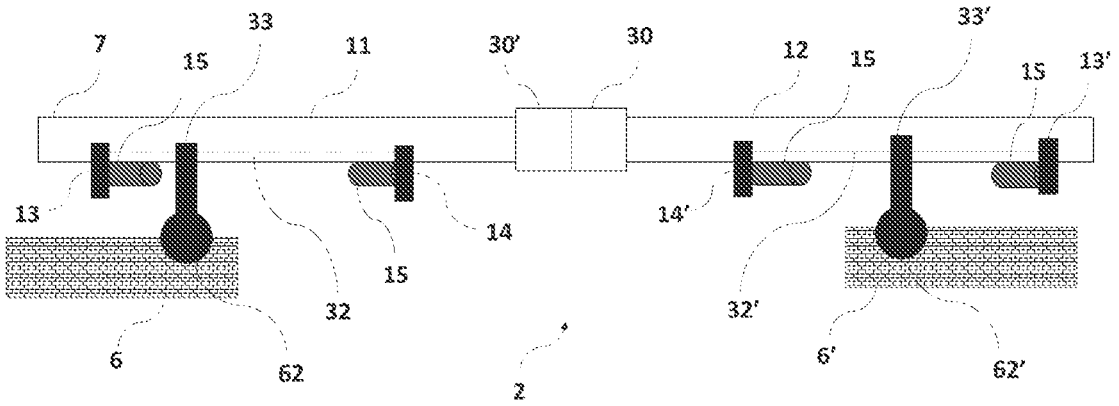
FIG. 3 is a schematic cross-sectional view of a mating device according to one embodiment of the invention for connecting two skates.
Figure 4:
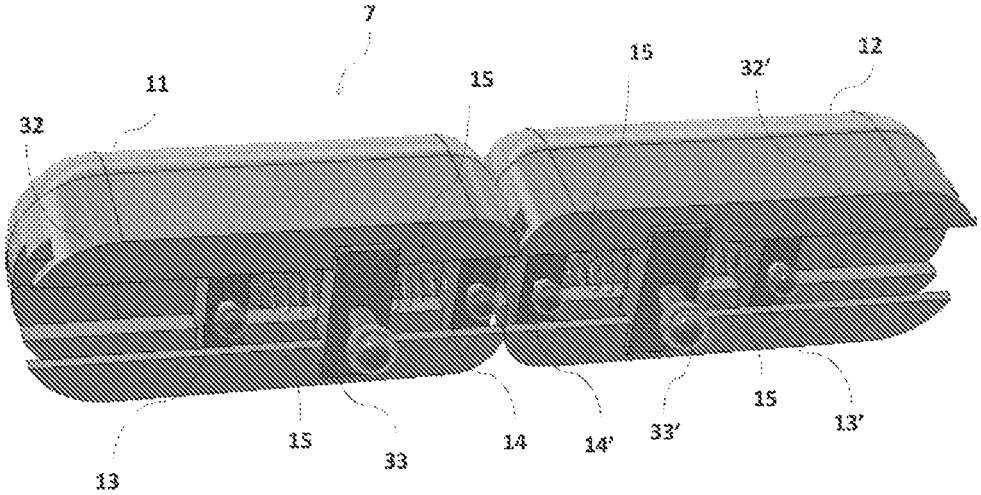
FIG. 4 is a perspective view of a body of a mating device according to a second embodiment of the invention in which translational movements of the shoes are limited.
Figure 5:
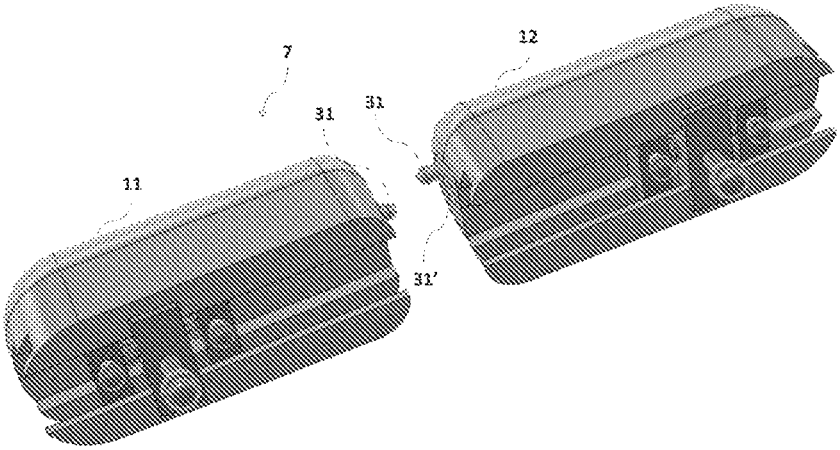
FIG. 5 is a perspective view of a body of a mating device according to one embodiment in which both portions of the body are detached.

In the embodiment shown in FIG. 3, the fastener composes two magnets 30, 30' on the end of the first portion 11 and the second portion 12. Alternatively, any fastener comprising at least one magnet can be implemented. Thus the connecting elements of portions 11, 12 are designed for a mutual magnetic connection, and for this purpose comprise at least one magnet, or even at least two magnets (one magnet each or more).

The magnet(s) 30, 30' are designed to be separated. This separation is obtained from a predetermined stress.

Said releasable fastener may comprise a material having a tensile strength of less than 30 MPa.

The first portion 11 and the second portion 12 may also include complementary fastening means, i.e., connecting elements, such as male/female pairs. These complementary fastening means or connecting elements may include at least one nipple 31 and at least one hole 31' designed to receive the nipple 31, as illustrated by a second embodiment in FIG. 5. In this embodiment, the at least one nipple 31 and the at least one hole 31' designed to receive nipple 31 comprise the two magnets 30, 30'.

Figure 9:
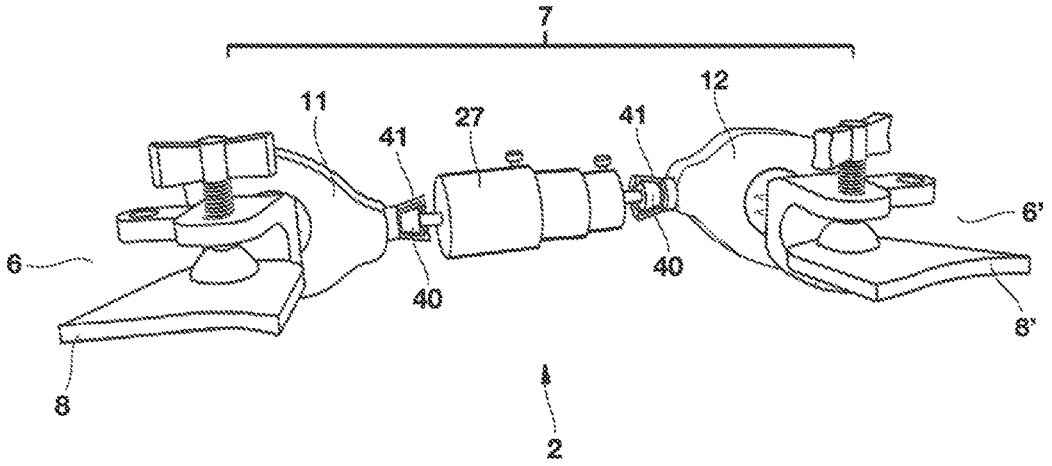
FIG. 9 is a perspective view of a body of a mating device according to a third embodiment.
Figure 10:
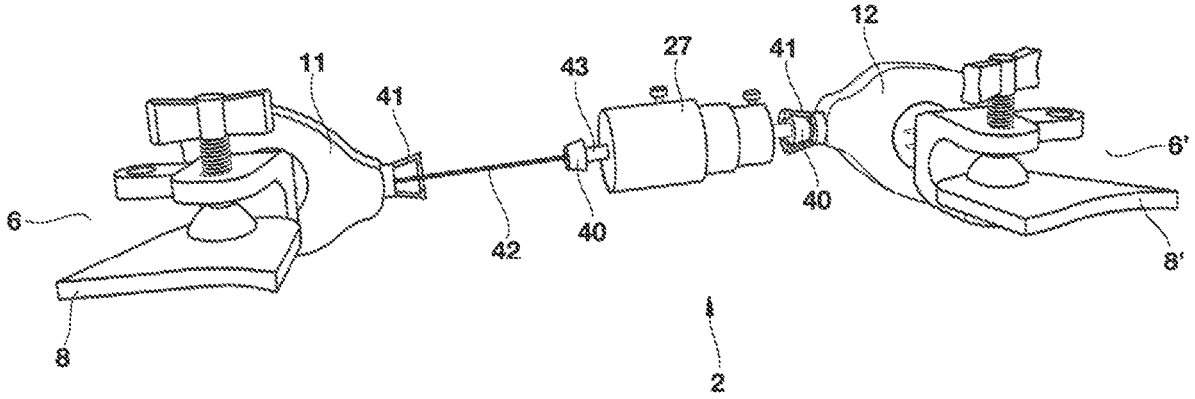
FIG. 10 is a perspective view of a body of a mating device according to the third embodiment in which the two body portions are detached.

FIGS. 9 and 10 illustrate a third embodiment of a removable magnetic connection between a first portion 11 and a second portion 12 of body 7. In this third embodiment, body 7 comprises a first portion 11 connected to the first module 6, a second portion 12 connected to the second module 6', and a third intermediate portion 27 connected respectively to the two first portions 11, 12. The two first portions 11, 12 thus form end portions of the body 7.

The third intermediate portion 27 comprises different parts that are movable relative to each other in order to adjust the length of this third portion 27. This construction allows body 7 to fulfill the function of translational freedom allowing the free change of the distance between the two fastening elements 6, 6' within a predefined limit. In this embodiment, the third portion comprises telescopic cylinders that are slidable relative to each other. Adjustment stops are provided to define the range of movement of each telescopic cylinder. Of course, any other arrangement that fulfills the same function in an equivalent manner can be considered as an alternative.

Each of the two first portions 11, 12 comprises a connecting element 41 for forming a detachable connection with a corresponding connecting element 40 of the third portion 27. This arrangement makes it possible to form two identical connections between the third portion 27 and the first portion 11 and the second portion 12, respectively. According to this embodiment, these two connections are detachable and magnetic. For this purpose, the connection elements 40, 41 implement a mutual magnetic fastening. On the other hand, according to this embodiment, the fastening element 40 of the third portion 27 has a truncated cone shape and is a magnet. The fastening element 41 of the end portions 11, 12 has a corresponding hollow shape, allowing the housing of the aforementioned truncated cone-shaped connecting element 40. Also, this hollow shape is open laterally, to allow the detachment of the truncated cone shape, along a particular predefined direction, as will be detailed below. Its end is also open for the passage of a connecting rod 43 connecting the frustoconical fastening element 40 to the third intermediate portion 27 in the fastening configuration. Alternatively, the second connection between the second portion 12 and the third portion 27 could be different, such as having different fastening elements, and/or not being removable, and/or not being magnetized.

FIG. 10 illustrates mating device 2 according to the third embodiment in a detached configuration, more precisely semi-detached indeed, in this configuration, the first portion 11 and the third intermediate portion 27 are detached. Their corresponding fastening elements 40, 41 are no longer connected. On the other hand, the second portion 12 and the third intermediate portion 27 remain attached to each other. Alternatively, these two portions 12, 27 could also be detached, in a similar manner to the two portions 11, 27.

According to the embodiment, a cable 42 is attached on the one hand to the fastening element 40 of the third portion 27 and on the other hand to the first portion 11. Advantageously, this first portion 11 incorporates an automatic winder, which allows the cable 42 to unwind automatically to increase the distance between the two portions 11, 27. However, the winder exerts a return force on cable 42, which winds the cable automatically if the two portions 11, 27 come closer together, and favors bringing the two portions 11, 27 closer together, to assist a user during a phase of fastening body 7. The same arrangement is symmetrically arranged between the second portion 12 and the third portion 27. Of course, this cable 42 remains optional and it is possible to envisage a variant of realization without cable.

The operation of this third embodiment is advantageous. It allows a user-friendly detachment of the mating device. For example, if the user wishes to take a walk with his two skates 8, 8', during which he/she no longer needs the support of mating device 2, he can easily detach the body portions 7 to achieve a detached configuration that favors this walk. The arrangement is such that this detachment can be achieved automatically by positioning the two skates 8, 8' in a predefined position, in this mode of implementation, it is sufficient to position the two skates according to parallel and close axes, and with one foot strongly advanced compared to the other. This position of the skates allows body 7 of mating device 2 to be positioned in a direction substantially parallel to the two skates 8, 8'. In this direction, the fastening elements 40, 40' separate automatically. As an additional remark, in case of a fall of the user, the forces exerted on body 7 have a sufficient amplitude to exceed the magnetic force of the magnetic connection. Moreover, the direction of the forces exerted is substantially random and eventually reaches the direction of detachment. Consequently, the solution also allows the automatic detachment of the portions of body 7 during a fall, beyond an exerted stress, for the safety of the user.

In addition, the third embodiment further assists the user in attaching the different portions of body 7, to move from the detached to the attached configuration, indeed, the user can reposition his skates in alignment as described for detachment, and then bring them closer together so that the cable(s) 42 automatically wind up completely, guiding at the same time the bringing together of the fastening elements 40, 40'. When the latter are close enough, the magnetic shape of the magnets is sufficient for their final approach in the fastening configuration. The Solution according to this embodiment thus allows for the automatic detachment and attachment of at least two portions of body 7.

According to one embodiment, there is thus a particular positioning of mating device 2, mainly of the relative position of the two fastening modules 6, 6', which allows the detachment or fastening of at least two portions separable by a removable connection. This particular positioning thus allows the transition from the detached configuration to the fastened configuration and vice versa. The other positions of mating device 2, mainly the relative position of the two fastening modules 6, 6', do not allow this configuration change.

The various embodiments described above could naturally be combined to form other embodiments. For example, a cable and a winder could also be arranged in the solutions of the embodiments of FIGS. 3, 4 and 5. The fastening elements could take other forms without departing from the scope of the invention. They could implement a magnetized connection, as described, or non-magnetized but for example simply clipped. Furthermore, body 7 may comprise two, three or more independent portions, movable relative to each other mainly detachable to form a removable connection of mating device 2.

In an embodiment not shown, the first portion and the second portion may comprise concentric tubes that slide within each other. Each portion is then attached to a fastener module by a mechanical connection that does not include translational degrees of freedom. The first portion can slide along the second portion between a first stop blocking the translation of the two portions in a first direction and a second stop blocking the translation of the two portions in a second direction opposite the first direction.

The distance between the two fastening modules then varies between a maximum distance and a minimum distance when the first portion is blocked by the first stop and the second stop respectively.

In one embodiment, the guide strand 3 is intended to be attached to the fastening module 6.

The fastening module 6 preferably comprises a plug-in connector 65 for receiving one end of the guide wire 3.

Figure 6:
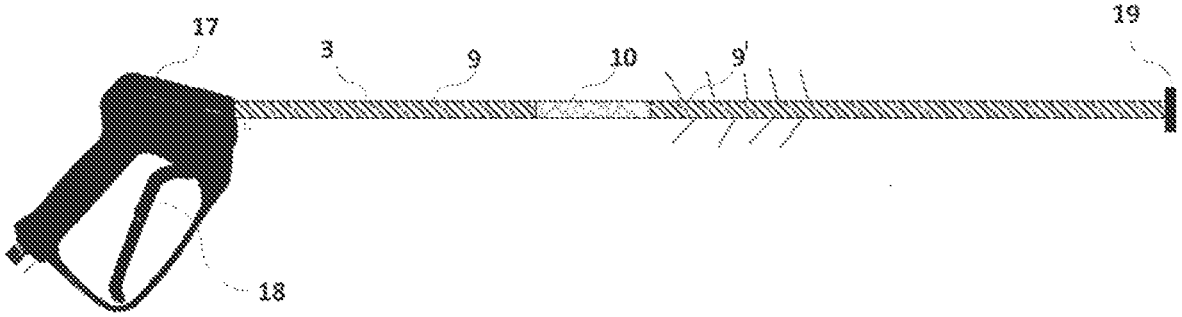
FIG. 6 is a schematic view of a guide strand of the system according to one embodiment of the invention.

An example of a guide strand 3 is described below with reference to FIG. 6.

Guide strand 3 preferably comprises at least a first elastic portion 9. The at least one elastic portion 9 allows to dampen the shocks when the strand 3 is put under tension. This elastic portion 9 advantageously allows learner 5 to feel the jolts less. Jolts can indeed be a source of imbalance, for example when there is a speed differential between the instructor and the learner and guiding strand 3 is tightened. Guiding strand 3 also advantageously comprises at least one portion provided with bangs 9' designed to increase its visibility.

Preferably, the elastic portion 9 allows elastic shock absorption in case of mechanical tension on guide strand 3 up to a predetermined stress.

Said elastic portion 4 may comprise an elastomeric material, such as synthetic polyisoprene (IR).

Guide strand 3 may further comprise a breakable or detachable portion 10. Said breakable or detachable portion 10 is designed to separate guide strand 3 into two parts upon mechanical stress above a predetermined stress. The two parts are the parts located on either side of said breakable or detachable portion 10.

Said breakable or detachable portion 10 may comprise a material having a tensile strength of less than 20 MPa.

Said breakable or detachable portion 10 may include a removable connection, said connection being capable of yielding when stressed above a given stress. Preferably, said releasable connection is reversible. For example, the removable connection may comprise a VELCRO® type fastening device or a flexible hook and/or loop closure. Said releasable connection may also include two magnets designed to be separated at a predetermined stress.

In one embodiment, resilient portion 9 comprises a material having a yield strength greater than the stress required to break the bond of said breakable or detachable portion 10.

Thus, in the event of an accident or if a guide strand 3 gets caught in an obstacle, the guide strand 3 breaks off into two parts. Skate 8 of learner 5 is then no longer mechanically connected to instructor 4.

In one embodiment, each guide strand 3 includes an automatic reel 17. The automatic winder 17 is designed to be earned in the hand of instructor 4. Advantageously, the automatic winder 17 allows guide strand 3 to be wound upon itself, thereby allowing instructor 4 to adjust the distance of guide strand 3 between itself and learner 5.

Preferably, the automatic winder 17 includes a trigger 18 designed to initiate automatic winding of the strand and/or automatic unwinding of guide strand 3.

The automatic wind 17 may include a means for remaining in proximity to the instructor's wrist if the instructor releases the wind. Said means may include a strap attached to wind 17 and intended to be passed around the neck or wrist of the instructor. The strap may also be intended to be attached to the instructor's suit, preferably at the sleeve.

Figure 7:
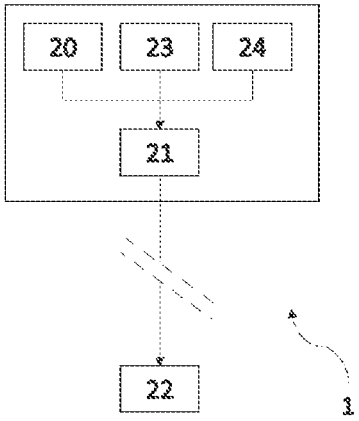
FIG. 7 is a schematic view of the electronic components present in one embodiment of the system.

In an embodiment shown in FIG. 7, the learning support system 1 includes a GPS chip 20 and transmission means 21 for transmitting position and movement information to a nearby electronic device 22. The electronic device 22 is preferably a cell phone.

System 1 may further comprise at least one inertial unit 23 for transmitting information regarding the learner's linear accelerations in the three orthogonal directions to the electronics 22.

The inertial unit 23 preferably includes three accelerometers that calculate the linear accelerations in three orthogonal axes.

System 1 may further include at least one gyrometer 24 for calculating and transmitting to the electronics 22 rotations or angular velocities of the learner.

The invention claimed is:

1. A ski coupling device comprising:

a first fastening module and a second fastening module, each designed to be fastened to a ski; and a body between the first and second fastening modules, the body being configured to allow at least translational freedom between the first and second fastening modules, a distance between the first and second fastening modules being free between a predetermined minimum distance and a predetermined maximum distance, the body being configured to allow a detachable connection between the first and second fastening modules;

wherein the body being configured for automatic detachment from a predetermined stress exerted between the first and second fastening modules.

2. The ski coupling device according to claim 1, wherein the body comprises at least one magnet for implementing a releasable connection between the first and second fastening modules.

3. The ski coupling device according to claim 1, wherein the body comprises a first portion connected to the first fastening module and a second portion connected to the second fastening module, the first portion and the second portion each comprising a connection element comprising at least one magnet configured to allow the first portion and the second portion to be mutually connected in a detachable manner, either directly or indirectly, by means of an intermediary third portion.

4. The ski coupling device according to claim 1, wherein the body comprises a particular positioning which allows the detachment or fastening of at least two portions separable by a removable connection configured to allow a passage from a detached configuration to a fastening configuration and vice versa.

5. The ski coupling device according to claim 1, wherein the body comprises at least one sliding connection, said sliding connection comprising at least one first stop and at least one second stop for keeping the distance between the first and second fastening modules respectively between the predetermined minimum distance and the predetermined maximum distance.

6. The ski coupling device according to claim 5 further comprises a damping means for progressive locking against the first stop and/or against the second stop.

7. The ski coupling device according to claim 1, wherein the body comprises a first portion comprising a slide connected to a carriage itself connected to the first fastening module, and in that the body comprises a second portion comprising a slide connected to a carriage itself connected to the second fastening module.

8. The ski coupling device according to claim 1, wherein each of the first and second fastening modules is mechanically connected to the body by a ball joint.

9. The ski coupling device according to claim 1, wherein the body comprises at least two portions linked together by fastening elements and by a cable attached to an automatic winder.

10. The ski coupling device according to claim 1 further comprises at least one strand, a first end of which is attached to the first fastening module and the second end of which is configured to be attached to a user.

11. The ski coupling device according to claim 10 further comprises an automatic winder for keeping the strand under tension and for blocking the strand when the strand reaches a predefined maximum length.

12. The ski coupling device according to claim 1 further comprises at least one leash with two guide strands, each of the guide strands being configured to be attached to a ski or to one of the first and second fastening modules so that the skis can be slowed or guided by the guide strands.

13. The ski coupling device according to claim 12, wherein each of the guide strands:

at least one automatic winder which comprises a trigger configured to trigger an automatic winding of the guide strands and/or an automatic unwinding of the guide strands;

at least one elastic portion; and at least one breakable or detachable portion configured to separate the guide strands into two parts in an event of mechanical tension above a predetermined stress.

14. The ski coupling device according to claim 1 further comprising a GPS chip connected to an electronic device by an information transmission means.

15. A ski coupling system comprising:

a first fastening module and a second fastening module, each designed to be fastened to a ski;

a body between the first and second fastening modules, the body being configured to allow at least translational freedom between the first and second fastening modules, a distance between the first and second fastening modules being free between a predetermined minimum distance and a predetermined maximum distance, the body being configured to allow a detachable connection between the first and second fastening modules;

at least two guide strands, each of the guide strands being configured to be attached to a ski or to one of the first and second fastening modules so that the skis can be slowed or guided by the guide strands; and an automatic winder for keeping the strand under tension and for blocking the strand when the strand reaches a predefined maximum length.

16. The ski coupling system according to claim 15, wherein the automatic winder comprises a trigger configured to trigger an automatic winding of the guide strands and/or an automatic unwinding of the guide strands; and wherein each of the guide strands including:

at least one elastic portion; and at least one breakable or detachable portion configured to separate the guide strands into two parts in an event of mechanical tension above a predetermined stress.

* * * * *